US006523311B2

(12) United States Patent
Edger

(10) Patent No.: US 6,523,311 B2
(45) Date of Patent: Feb. 25, 2003

(54) T-MULLION

(75) Inventor: Ronal Fredrick Edger, Bolton (CA)

(73) Assignee: Royal Group Technologies Limited, Woodbridge (CA)

( * ) Notice: Subject to any disclaimer, the term of this patent is extended or adjusted under 35 U.S.C. 154(b) by 0 days.

(21) Appl. No.: 09/916,451

(22) Filed: Jul. 30, 2001

(65) Prior Publication Data

US 2002/0011039 A1 Jan. 31, 2002

(30) Foreign Application Priority Data

Jul. 31, 2000 (CA) ..... 2314789

(51) Int. Cl.[7] ..... E06B 7/00

(52) U.S. Cl. ..... 52/204.593

(58) Field of Search ..... 52/204.593, 204.54, 52/204.57, 204.53, 204.58, 204.6, 204.71, 204.72

(56) References Cited

U.S. PATENT DOCUMENTS

| | | | | | |
|---|---|---|---|---|---|
| 4,015,388 | A | * | 4/1977 | Hemminger | 52/395 |
| 5,026,581 | A | * | 6/1991 | Shea et al. | 428/34 |
| 5,435,106 | A | * | 7/1995 | Garries et al. | 49/DIG. 2 |
| 5,524,403 | A | * | 6/1996 | Fullwood | 52/202 |
| 6,360,498 | B1 | * | 3/2002 | Westphal | 52/204.1 |

FOREIGN PATENT DOCUMENTS

GB 2 254 873 A * 10/1992

* cited by examiner

*Primary Examiner*—Ramon O. Ramirez
*Assistant Examiner*—Kofi Schulterbrandt

(57) ABSTRACT

A window which comprises a hollow mullion plastic extrusion and a metal insert. The plastic extrusion is of a general T-shape having a hollow head portion and a hollow foot portion connected by a hollow stem portion which is open to both the hollow head and foot. The metal insert is of general T-shape having a head portion of the plastic extrusion, a stem portion to extend through the hollow stem of the plastic extrusion to support same and a foot portion to fit within and expand the hollow foot portion of the plastic extrusion.

12 Claims, 3 Drawing Sheets

T-MULLION

FIELD OF THE INVENTION

This invention relates to improvements in window construction and more particularly to an improved mullion for high performance windows.

BACKGROUND OF THE INVENTION

The strength of the mullion which provides the central support between window lights in a divided window structure is an important factor in giving wind load resistance and hence rating of the window. The importance of this mullion is increased with increasing window height with windows, for example, having a height of 72 inches being frequently encountered.

The mullions in such windows have been formed as hollow generally T-shaped extrusions with an enlarged hollow head, a narrow stem depending from the head to a hollow foot, To provide strength to the mullion it has been considered necessary to provide the mullion extrusion with a series of internal walls. To further increase the strength of the mullion, a metal insert has been introduced into the hollow mullion head. However, the presence of the internal walls of the mullion extrusion blocks the use of any insert spanning between the head and foot of the mullion.

It is the object of the present invention to provide a mullion having greatly increased strength over existing mullions.

SUMMARY OF THE INVENTION

According to the present invention, the mullion for a divided window comprises a generally T-shaped hollow plastic extrusion in which there are no internal walls between the hollow head and the hollow foot of the T and providing a generally T-shaped reinforcing insert adapted to be sleeved down into the plastic T with the insert having a head portion bracing the extruded plastic head, a stem portion extending from the head down through the plastic stem and into the foot of the plastic extrusion.

According to the preferred form of the invention, interengaging means are provided between the insert and the plastic extrusion to prevent spreading of the stem portion of the plastic extrusion.

In this connection, according to a preferred form of the invention, the plastic extrusion has longitudinal internal ribs at each side of the stem portion where it opens into the hollow head of the extrusion and where it opens into the hollow foot of the extrusion and the reinforcing insert has lateral arms with end flanges or fingers to engage over the internal plastic ribs to prevent their separation under loading. Further, according to the preferred form of the invention, the reinforcing insert is formed with laterally extending arms intermediate the head of the T and the rib engaging arms where the stem of the plastic T opens into the head of the plastic T. These intermediate arms being provided at their ends with part circular screw receptors.

Similarly, according to a preferred form of the invention, the foot portion of the reinforcing insert is provided with a central part cylindrical portion forming a screw receptor.

Again, according to the preferred form of the invention, the metal insert is an elongated aluminum extrusion. However, other suitable inserts such as those formed from fiberglass by pultrusion may also be used.

DETAILED DESCRIPTION ACCORDING TO THE PREFERRED EMBODIMENTS OF THE PRESENT INVENTION

Figure 1:
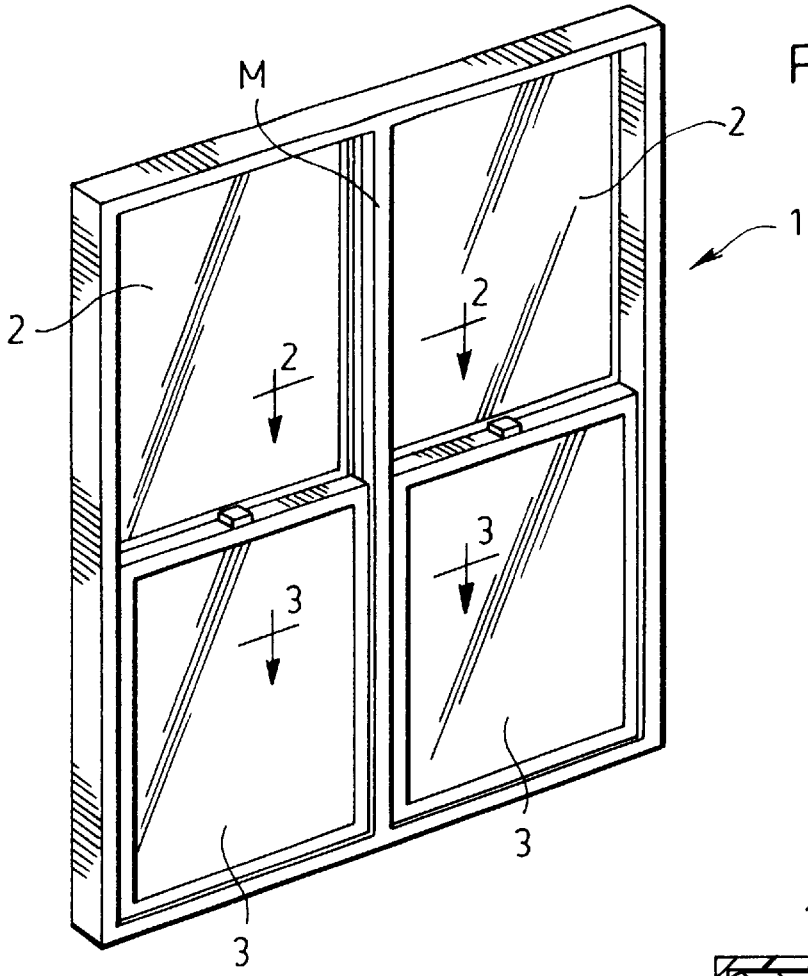
FIG. 1 is a perspective view of a divided single hung window employing a T-mullion according to the invention between the window lights.

FIG. 1 is a perspective view of a divided single hung window unit generally designated at 1 having fixed upper lights 2 and lower sliding sashes 3 divided by a mullion M embodying the invention.

Figure 5:
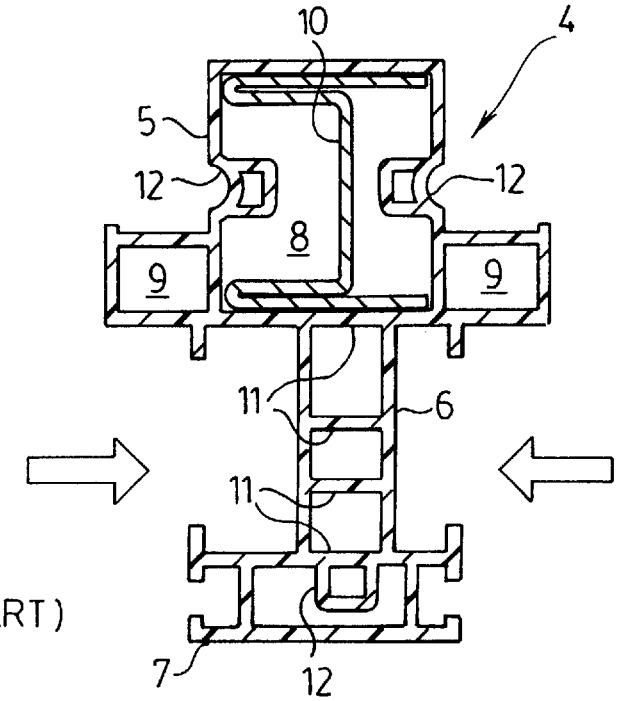
FIG. 5. (PRIOR ART)
FIG. 5 is a horizontal sectional view of a typical prior art mullion.

Before describing the details of the mullion M, reference is first made to FIG. 5 which shows a typical prior art mullion for such a window. As seen in FIG. 5, the mullion comprises a generally T-shaped plastic extrusion 4 having a hollow head 5, a hollow stem 6 and a hollow foot 7. The head 5 includes the main hollow portion 8 and two laterally extending top light supporting hollow boxes 9 which give the head 5 of the T the appearance of a top hat.

In such prior art mullion, a suitably shaped metal insert 10 is inserted into the main hollow portion 8 of the head 5 while the extrusion is provided with a series of internal walls 11 bridging the hollow stem 6 to prevent both inward collapse or outward bowing of the stem under wind forces.

Also the hollow head 5 and the hollow foot 5 are provided with internal screw receptors 12.

Because of the deemed necessity for the multiple internal wall bracing of the stem, it has not been considered possible to provide totally adequate support or bracing for the extruded plastic component of the T-mullion, a problem now solved by the present invention.

Figure 2:
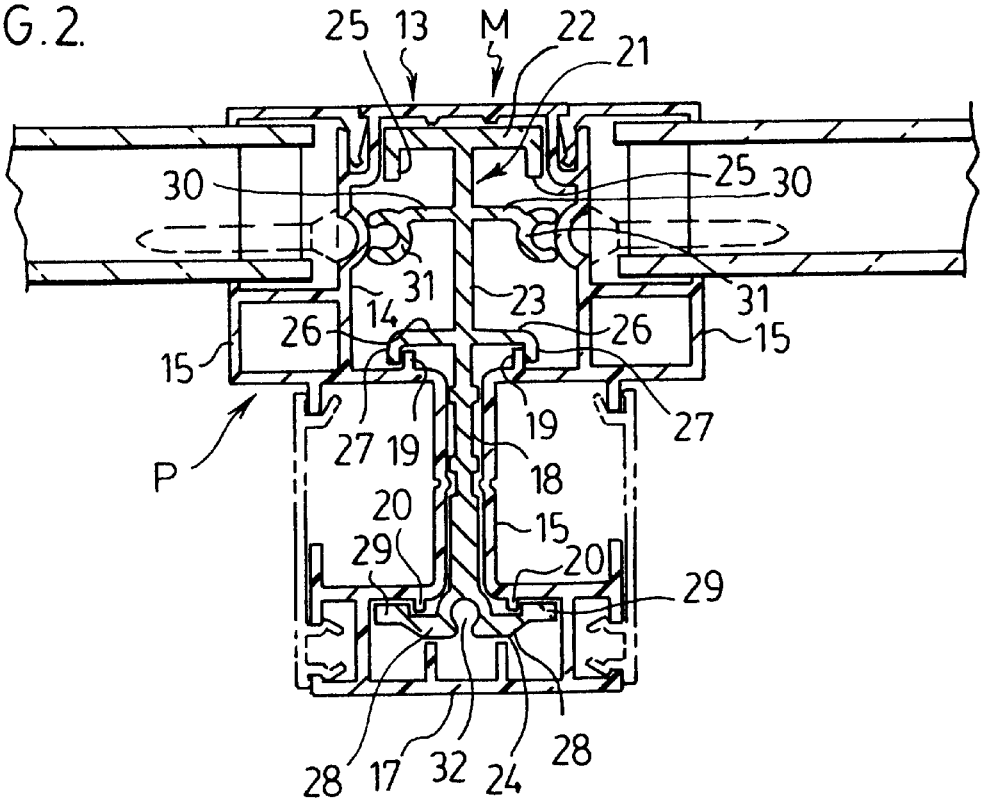
FIG. 2 is a broken away horizontal section through the window mullion taken on the line 2—2 of FIG. 1.

With reference to FIG. 2, which is a cross section on the line 2—2 of FIG. 1, it will be seen that the mullion M, as in the case of the prior art, comprises a hollow plastic extrusion P having a generally T-shaped cross section having a head portion 13 having the appearance of a top hat with a main hollow section 14 and lateral hollow box like wings 15 to support the fixed upper lights 2.

Depending from the head portion 13 is a narrow hollow stem portion 16 joining the head portion 13 to a hollow foot portion 17 which provides cooperative support for the sliding sashes 3 the details of which are not part of the present invention.

It will be noted that the hollow stem 16 of the mullion M is open to the hollow main head section 14 and is also open to the hollow foot portion 17 and has no internal walls so that there is a clear passage 18 between the hollow head portion 14 and the foot portion 17.

The interior of the hollow head portion 14 is provided with ribs 19 on opposite sides of the entrance to the stem passage 18.

Similarly, the hollow foot portion 17 is provided with internal ribs 20 on opposite sides of the stem passage 18 where it opens into the hollow foot portion 17.

Sleeved within the T-shaped hollow extrusion P is a T shaped reinforcing insert generally designated at 21 preferably formed as a length of extruded aluminum. However, such insert could also, for example, be formed of fiber glass produced by pultrusions.

The insert 21 has a head portion 22, a stem portion 23, and a foot portion 24. The head portion 22 extends transversely across the outer end of the stem portion 23 to butt against the interior top of the main hollow section 14 of the head portion 13 of the plastic extrusion P and has downturned flanges 25 to give lateral support to the plastic head portion 13.

The stem portion 23 of the insert extends through the passage 18 of the stem 16 of the plastic extrusion in a close fit to prevent inward collapse of the plastic stem 16. The foot portion 24 of the insert fits within the hollow front portion 17 of the plastic extrusion.

Extending outwardly from the reinforcing insert stem 23 within the hollow head portion 14 are arms 26 having downturned fingers 27 which engage over the ribs 19 either side of the hollow stem portion 16 of the plastic extrusion 12 to block opening up or widening of the passage 18 at the end where the passage opens into the hollow head portion 14.

Similarly, the foot portion 24 of the insert 21 is formed with laterally extending arms 28 ending in upturned fingers or flanges 29 which engage over the ribs 22 formed internally of the hollow foot portion 17 of the extrusion 12 to bar opening up or widening of the passage 18 at the end where it opens up into the hollow foot portion 17 of the plastic extrusion.

It will thus be seen that with the stem portion 23 of the insert 21 engaging the interior walls of the passage 18 to prevent inward collapse of the passage and with the fingers 27 of the arms 26 of the insert engaging the ribs 19 and the fingers 29 of the arms 28 engaging over the ribs 20 the passage will be prevented from opening away from the support of the stem portion 23 of the insert.

It will thus be seen that the T-shaped insert provides reinforcement completely through from the front to the rear of the extruded member P of the mullion M from the front to the rear of the mullion M as well as lateral support transversely of the mullion M. This reinforcement is augmented by providing the interaction between the blocking fingers 27 and 29 of the insert 21 and the ribs 19 and 20 respectively formed internally of the plastic head portion 14 and the plastic foot portion 17.

The insert 21 is further provided with lateral arms 30 intermediate the head portion 22 and the arms 26 with these arms 30 ending in part cylindrical screw receptors 31 located in the same position as the screw receptors 12 shown in the hollow head 5 of the prior art mullion FIG. 5. Similarly, the foot portion 24 of the insert 21 has a part cylindrical screw receptor 32 located at the point where the screw receptor 12 in the hollow foot 7 of the prior art mullion shown in FIG. 5 was located.

By providing the screw receptors 31 and 32 as part of the insert 31 the mullion M provides increased screw retention power over prior art mullions.

Figure 3:
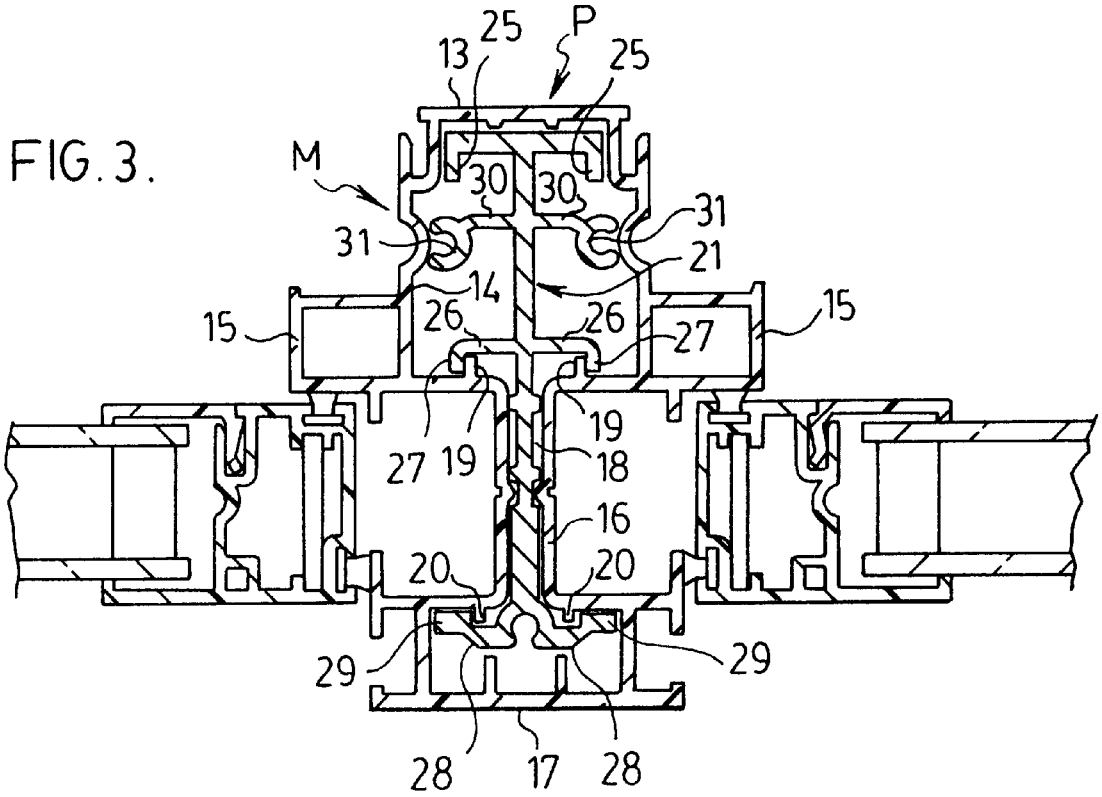
FIG. 3 is a cross sectional view of the mullion taken on the line 3—3 of FIG. 1.

FIG. 3 is a cross section taken on the line 3—3 of FIG. 1 and shows the mullion M supporting the lower sashes 3 in the conventional manner with prior art mullions the details of which are not part of the present invention.

Figure 4:
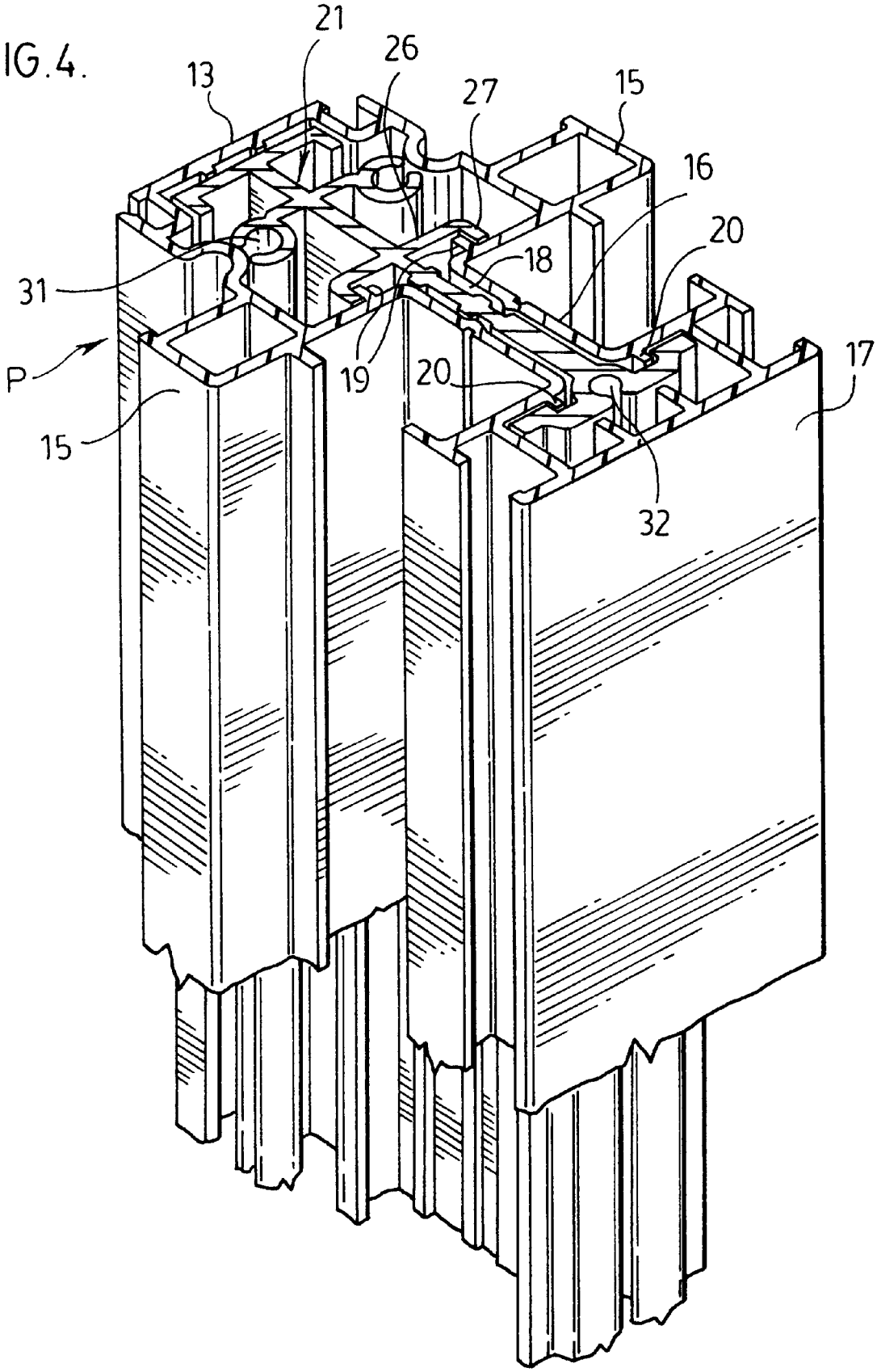
FIG. 4 is a broken away perspective view of a section of the mullion.

FIG. 4 is a broken away perspective view of the mullion M with the insert 21 sleeved within the plastic extrusion P and indicating an indefinite length as the mullion M can be of any desired length.

It will be appreciated that the importance of providing a reinforcing insert extending from the front to the back of the mullion M to increase its strength in both the front to back and lateral directions increases with increasing window height.

Although the preferred embodiment of the invention has been described in detail, it will be appreciated by those skilled in the art that variations may be made thereto without departing from the scope of the appended claims.

The embodiments of the invention in which an exclusive property or privilege is claimed are defined as follows:

1. A window mullion comprising the combination of an elongated generally T-shaped hollow plastic extrusion having a hollow head, a hollow foot, and a hollow stem connecting said head and foot and open to each said head and foot to provide a continuous passage therebetween, and an elongated generally T-shaped reinforcing insert adapted to be sleeved into said generally T-shaped plastic extrusion, said insert having a head portion to internally support the head of said plastic extrusion, a stem portion to fit within, extend through and prevent collapse of said hollow stem of said plastic extrusion and a foot portion to fit within and provide internal support for said hollow foot of said plastic extrusion.

2. A window mullion as claimed in claim 1 in which said hollow plastic extrusion and said reinforcing insert have interengaging means to prevent displacement of said plastic stem away from said insert stem.

3. A window mullion as claimed in claim 1 in which said reinforcing insert is provided with part cylindrical screw receptors.

4. A window mullion as claimed in claim 1 in which said plastic extrusion is formed with an longitudinal rib extending parallel to said hollow stem at each side of said hollow stem where it opens into said hollow head and said hollow foot, and said insert is provided with lateral arms having end flanges to hook over said ribs at each end of said stem to prevent movement of said plastic stem away from said insert stem.

5. A window mullion as claimed in claim 1, 2 or 3 in which said metal insert is selected from one of an extruded aluminum member and a pultruded fiberglass member.

6. A window mullion member comprising an elongated plastic extrusion of generally T-form having a hollow head portion, a hollow stem portion, and a hollow foot portion, said stem portion opening at its ends to both said hollow head portion and said head hollow foot portion to provide a continuous passageway therebetween.

7. A window mullion member as claimed in claim 6 in which said hollow head portion and said hollow foot portion each has an internal rib on each side of the said hollow stem portion where it opens thereinto.

8. A reinforcing insert for a window mullion comprising an elongated generally T-shaped member having a laterally extending head portion with outer downturned flanges, a laterally extending foot portion with outer upturned flanges, and an elongated stem centrally connecting said head and foot portions, said stem having at each side thereof at a point intermediate said head and foot portions a laterally extending arm having an outer downturned flange.

9. A reinforcing insert as claimed in claim 8 in which said foot portion comprises a pair of laterally extending arms, one said arm extending outwardly from said stem on each side thereof, said arms having upwardly turned end flanges.

10. A reinforcing insert as claimed in claim 9 formed with lateral arms adjacent the head portion terminating in part cylindrical screw receptors and said foot portion being provided with a central part cylindrical screw receptor.

11. A reinforcing insert as claimed in claim 8, 9 or 10 formed of extruded aluminum.

12. A reinforcing insert as claimed in claim 8, 9 or 10 formed of pultruded fiberglass.

* * * * *